United States Patent [19]

Simson et al.

[11] Patent Number: 4,650,746

[45] Date of Patent: Mar. 17, 1987

[54] HIGH CONTRAST PHOTOGRAPHIC EMULSIONS AND ELEMENTS AND PROCESSES FOR THEIR DEVELOPMENT

[75] Inventors: Joseph M. Simson; Harold E. Jordan, both of Rochester, N.Y.

[73] Assignee: Eastman Kodak Company, Rochester, N.Y.

[21] Appl. No.: 57,042

[22] Filed: Jul. 12, 1979

Related U.S. Application Data

[63] Continuation of Ser. No. 944,940, Sep. 22, 1978, abandoned.

[51] Int. Cl.[4] ..... G03C 1/10; G03C 5/30; G03C 1/34

[52] U.S. Cl. ..... 430/438; 430/437; 430/439; 430/440; 430/446; 430/448; 430/481; 430/482; 430/487; 430/490; 430/567; 430/598; 430/600

[58] Field of Search ..... 430/448, 481, 482, 607, 430/490, 437, 567, 438, 439, 440, 569, 446, 487, 598, 600

[56] References Cited

U.S. PATENT DOCUMENTS

| | | | |
|---|---|---|---|
| 2,410,690 | 11/1946 | Smith | 96/107 |
| 2,419,974 | 5/1947 | Stauffer et al. | 96/107 |
| 2,419,975 | 5/1947 | Trivelli | 96/107 |
| 2,892,715 | 6/1959 | Hunsberger | 96/66.5 |
| 3,227,552 | 1/1966 | Whitmore | 96/64 |
| 3,340,058 | 9/1967 | von Konig | 96/28 |
| 3,386,831 | 6/1968 | Honig | 96/109 |
| 3,447,927 | 6/1969 | Bacon | 96/107 |
| 3,730,727 | 5/1973 | Olivares et al. | 96/95 |
| 3,782,949 | 1/1974 | Olivares et al. | 96/95 |
| 3,793,027 | 2/1974 | Okutsu et al. | 96/66.5 |
| 4,168,977 | 9/1979 | Takada et al. | 430/448 |
| 4,224,401 | 9/1980 | Takada et al. | 430/437 |

FOREIGN PATENT DOCUMENTS

| | | | |
|---|---|---|---|
| 855453 | 10/1977 | Belgium | 96/95 |

OTHER PUBLICATIONS

Smith & Trivelli; "The Influence of Photographic Developers Containing Hydrazine Upon the Characteristic Curves of Photographic Materials," Journal of Franklin Institute, vol. 238, Oct. 1944 pp. 291–298.

*Primary Examiner*—Richard L. Schilling
*Attorney, Agent, or Firm*—J. Jeffrey Hawley

[57] ABSTRACT

This invention relates to a photographic element comprising a support, and coated on the support at least one negative-working photographic emulsion comprising radiation-sensitive silver halide grains capable of forming a surface latent image and a binder, and in the support or in a remaining hydrophilic colloid layer coated on the support in an amount sufficient to increase contrast, a hydrazine compound of the formula $$R^1\text{—NHNH}\overset{\overset{\displaystyle O}{\|}}{C}\text{H}$$

wherein $R^1$ is a phenyl nucleus having a Hammet sigma value-derived electron withdrawing characteristic of less than +0.30.

13 Claims, 1 Drawing Figure

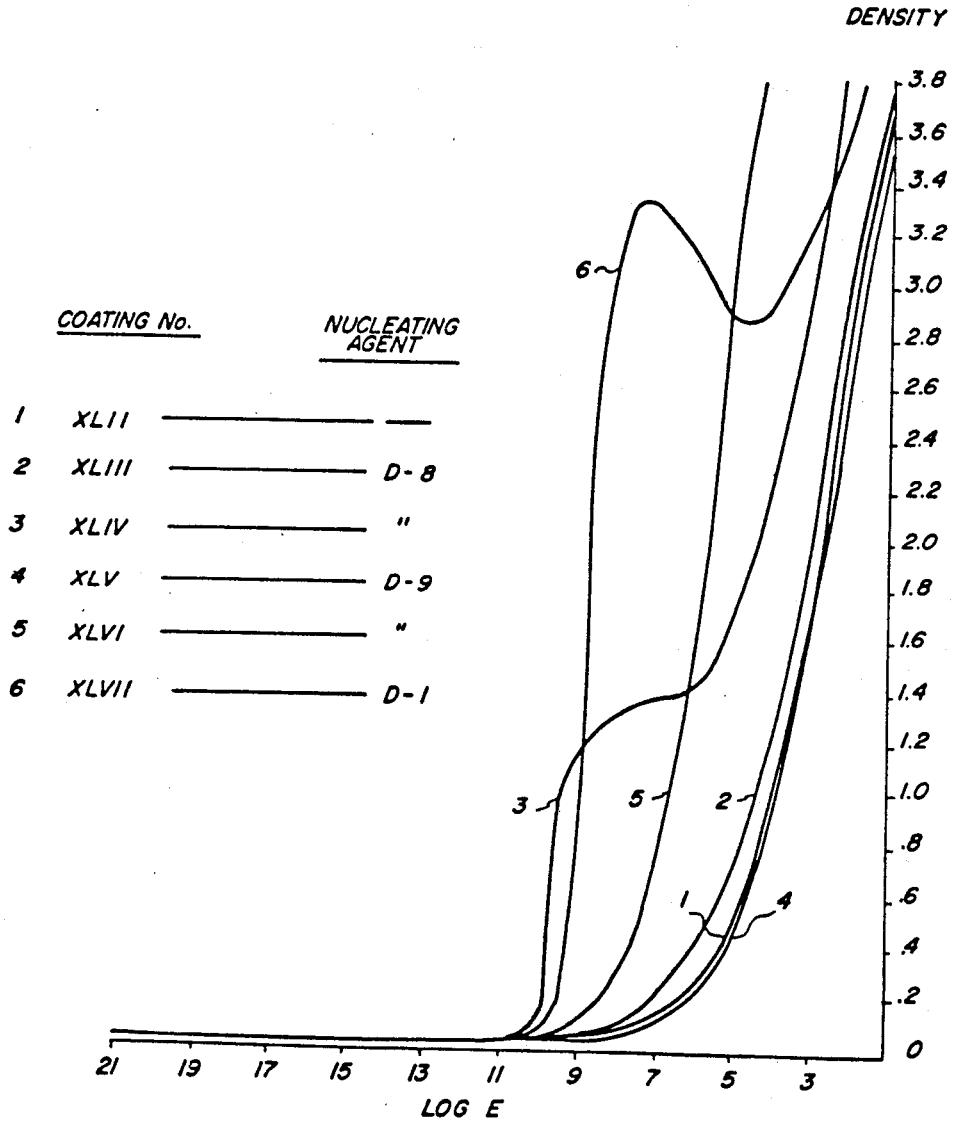
DENSITY
3.8
3.6
3.4
3.2
3.0
2.8
2.6
2.4
2.2
2.0
1.8
1.6
1.4
1.2
1.0
.8
.6
.4
.2
0
COATING No.
NUCLEATING AGENT
1 XLII —
2 XLIII D-8
3 XLIV "
4 XLV D-9
5 XLVI "
6 XLVII D-1
6
3
5
2
1
4
21
19
17
15
13
11
9
7
5
3
LOG E

HIGH CONTRAST PHOTOGRAPHIC EMULSIONS AND ELEMENTS AND PROCESSES FOR THEIR DEVELOPMENT

This is a continuation of application Ser. No. 944,940 filed Sept. 22, 1978, now abandoned.

FIELD OF THE INVENTION

This invention is directed to a negative-working photographic emulsion, to a photographic element containing a negative-working emulsion layer and to a process forming an image with such a photographic element.

DESCRIPTION OF THE STATE OF THE ART

Relatively high contrast negative-working photographic elements have been recognized to have practical photographic imaging applications. For example, hydrazine compounds have been employed to increase contrast, preferably in combination with an antifoggant. Smith et al U.S. Pat. Nos. 2,410,690, Stauffer et al 2,419,974, Trivelli et al 2,419,975, Hunsberger 2,892,715 and Stauffer, Smith and Trivelli, "The Influence of Photographic Developers Containing Hydrazine Upon the Characteristic Curves of Photographic Materials", *Journal of the Franklin Institute.* Vol. 238, October 1944, pp. 291–298, illustrate basic discoveries pertaining to relatively high contrast imaging with negative-working silver halide photograhic elements.

Very high contrast ($\gamma > 10$) negative-working silver halide emulsions and photographic elements are commonly referred to as "lith" emulsions and photographic elements, since they are useful in forming halftone masters for plate exposures in photolithography. Typical lith silver halide photographic elements contain high chloride emulsions (at least about 60 percent by weight silver chloride, based on total silver halide), typically in the form of silver chlorobromides or silver chlorobromoiodides. Very high contrast is achieved using a phenolic developing agent, such as a hydroquinone, limiting the use of secondary developing agents and limiting sulfite preservatives to avoid interference with hydroquinone oxidation products. Hydrazine compounds have not been employed in these very high contrast emulsions and photographic elements.

Conventional approaches to obtaining very high contrast images with negative-working silver halide photographic elements have exhibited a number of disadvantages. First, using silver chloride-containing emulsions, the higher photographic speeds of silver bromide and silver bromoiodide emulsions have not been achieved. Second, the requirement of using hydroquinone developing agents has limited the selection of photographic developer compositions. Third, the need to limit sulfite preservative concentrations has resulted in lack of stability during storage of developers.

SUMMARY OF THE INVENTION

The present invention achieves the unexpected advantages of higher speed and very high contrast through the use of selected hydrazine compounds. In a preferred form advantages are obtained by employing these hydrazine compounds in combination with a specific class of antifoggants. This invention obtains very high contrasts using silver halide emulsions generally, rather than just high chloride emulsions. Further, very high contrast images are obtained using conventional photographic developers having higher sulfite concentrations than have heretofore been employed in processing of lith photographic elements. Specifically, this invention achieves the advantage of being able to employ developers which are more storage stable. Further, auxiliary, nonphenolic developing agents can be employed to increase developer capacity and reduce induction times. This invention then expands both the choice of silver halide emulsions and developers which can be employed in obtaining relatively high contrast photographic images.

In one aspect this invention is directed to a negative-working photographic emulsion comprised of radiation-sensitive silver halide grains capable of forming a surface latent image, a binder and, in an amount sufficient to increase contrast, a hydrazine compound of the formula $$R^1\text{—NHNH}\overset{\overset{\displaystyle O}{\|}}{C}\text{H}$$

wherein $R^1$ is a phenyl nucleus having a Hammett sigma value-derived electron withdrawing characteristic of less than +0.30.

In another aspect this invention is directed to a photographic element comprising a support, coated on the support at least one negative-working photographic emulsion comprising radiation-sensitive silver halide grains capable of forming a surface latent image and a binder and, in the emulsion or in a remaining hydrophilic colloid layer coated on the support in an amount sufficient to increase contrast, a hydrazine compound of the formula $$R^1\text{—NHNH}\overset{\overset{\displaystyle O}{\|}}{C}\text{H}$$

wherein $R^1$ is a phenyl nucleus having a Hammett sigma value-derived electron withdrawing characteristic of less than +0.30.

In an additional aspect this invention is directed to an improvement in developing an imagewise exposed photographic element as described above wherein the developer contains about 0.15 mole or more of sulfite ion per liter and has a pH of from about 11.0 to 12.3.

This invention can be better appreciated by reference to the following detailed description considered in conjunction with the drawing, in which characteristic curves for photographic elements containing 1-formyl-2-phenylhydrazines according to this invention are compared with similar photographic elements containing pyridinium hydrazide and semicarbazide compounds in similar and higher concentrations.

DESCRIPTION OF THE PREFERRED EMBODIMENTS

The hydrazine compounds employed in the practice of this invention exhibit the following general formula:

$$R^1\text{—NHNH}\overset{\overset{\displaystyle O}{\|}}{C}\text{H}$$

wherein $R^1$ is a phenyl nucleus having a Hammett sigma value-derived electron withdrawing characteristic of less than +0.30.

$R_1$ can take the form of a phenyl nucleus which is either electron donating (electropositive) or electron withdrawing (electronegative); however, phenyl nuclei which are highly electron withdrawing produce inferior nucleating agents. The electron withdrawing or electron donating characteristic of a specific phenyl nucleus can be assessed by reference to Hammett sigma values. The phenyl nucleus can be assigned a Hammett sigma value-derived electron withdrawing characteristic which is the algebraic sum of the Hammett sigma values of its substituents (i.e., those of the substituents, if any, to the phenyl group). For example, the Hammett sigma values of any substituents to the phenyl ring of the phenyl nucleus can be determined algebraically simply by determining from the literature the known Hammett sigma values for each substituent and obtaining the algebraic sum thereof. Electron withdrawing substituents are assigned negative sigma values. For example, in one preferred form $R^1$ can be a phenyl group which is unsubstituted. The hydrogen attached to the phenyl ring each have a Hammett sigma value of 0 by definition. In another form the phenyl nuclei can include halogen ring substituents. For example, ortho- or para-chloro or fluoro substituted phenyl groups are specifically contemplated, although the chloro and fluoro groups are each mildly electron withdrawing.

Preferred phenyl group substituents are those which are not electron withdrawing. For example, the phenyl groups can be substituted with straight or branched chain alkyl groups (e.g., methyl, ethyl, n-propyl, isopropyl, n-butyl, isobutyl, n-hexyl, n-octyl, tert-octyl, n-decyl, n-dodecyl and similar groups). The phenyl groups can be substituted with alkoxy groups wherein the alkyl moieties thereof can be chosen from among the alkyl groups described above. The phenyl groups can also be substituted with acylamino groups. Illustrative acylamino groups include acetylamino, propanoylamino, butanoylamino, octanoylamino, benzoylamino and similar groups.

In one particularly preferred form the alkyl, alkoxy and/or acylamino groups are in turn substituted with a conventional photographic ballast, such as the ballasting moieties of incorporated couplers and other immobile photographic emulsion addenda. The ballast groups typically contain at least eight carbon atoms and can be selected from both aliphatic and aromatic relatively unreactive groups, such as alkyl, alkoxy, phenyl, alkylphenyl, phenoxy, alkylphenoxy and similar groups.

The alkyl and alkoxy groups, including ballasting groups, if any, preferably contain from 1 to 20 carbon atoms, and the acylamino groups, including ballasting groups, if any, preferably contain from 2 to 21 carbon atoms. Generally, up to about 30 or more carbon atoms in these groups are contemplated in their ballasted form. Methoxyphenyl, tolyl (e.g., p-tolyl and m-tolyl) and ballasted butyramidophenyl nuclei are specifically preferred.

Although the hydrazine compounds intended for use in the practice of this invention each contain a formyl moiety, it is appreciated that otherwise comparable hydrazine compounds containing a benzoyl moiety which is substituted with a highly electron withdrawing substituent, such as a cyano group, are operative. Such compounds have, however, been found to be inferior to the hydrazine compounds containing a formyl moiety.

The synthesis of 1-formyl-2-phenylhydrazine compounds employed in the practice of this invention is well known in the art and need not be described in detail. Generally such compounds can be formed by reacting formic acid or its salt with the corresponding phenylhydrazine. The conventional nature of the 1-formyl-2-phenylhydrazine compounds as such is illustrated by Honig et al U.S. Pat. No. 3,386,831, which shows 1-acetyl-2-phenylhydrazine and homologues formed by higher molecular weight carboxylic acid adducts, and Olivares et al U.S. Pat. No. 3,782,949, which shows 1-formyl-2-phenylhydrazine, there designated formyl-β-phenylhydrazine.

The following are illustrative of specifically preferred hydrazine compounds useful in the practice of this invention:

1-Formyl-2-{4-[2-(2,4-di-tert-pentylphenoxy)-butyramido]phenyl}hydrazine D-1

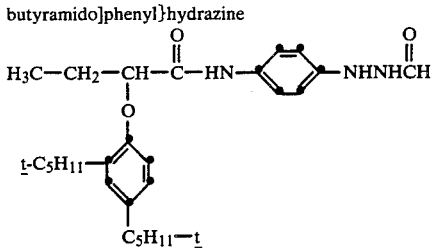

1-Formyl-2-phenylhydrazine D-2

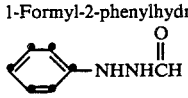

1-Formyl-2-(4-methoxylphenyl)hydrazine D-3

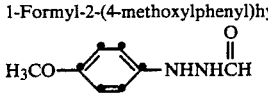

1-Formyl-2-(4-chlorophenyl)hydrazine D-4

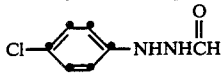

1-Formyl-2-(4-fluorophenyl)hydrazine D-5

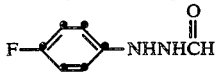

1-Formyl-2-(2-chlorophenyl)hydrazine D-6

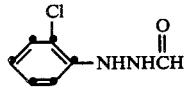

1-Formyl-2-(p-tolyl)hydrazine D-7

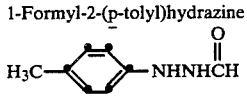

The hydrazine compounds are present in the photographic elements of this invention in a concentration of from about $10^{-4}$ to about $10^{-1}$ mole per mole of silver. A preferred quantity of the hydrazine compound is from $5\times10^{-4}$ to about $5\times10^{-2}$ mole per mole of silver. Optimum rests are obtained when the hydrazine compound is present in a concentration of from about $8\times10^{-4}$ to about $5\times10^{-3}$ mole per mole of silver. The hydrazine compound can be incorporated in a silver halide emulsion used in forming the photographic element. Alternatively the hydrazine compound can be present in a hydrophilic colloid layer of the photographic element, preferably a hydrophilic colloid layer which is coated to be contiguously adjacent to the emulsion layer in which the effects of the hydrazine compound are desired. The hydrazine can, of course, be present in the photographic element distributed between or among emulsion and hydrophilic colloid layers, such as undercoating layers, interlayers and overcoating layers.

The hydrazine compounds are employed in combination with negative-working photographic emulsions comprised of radiation-sensitive silver halide grains capable of forming a surface latent image and a binder. The silver halide emulsions include the high chloride emulsions conventionally employed in forming lith photographic elements as well as silver bromide and silver bromoiodide emulsions, which are recognized in the art to be capable of attaining higher photographic speeds. Generally the iodide content of the silver halide emulsions is less than about 10 mole percent silver iodide, based on total silver halide.

The silver halide grains of the emulsions are capable of forming a surface latent image, as opposed to being of the internal latent image-forming type. Surface latent image silver halide grains are employed in the overwhelming majority of negative-working silver halide emulsions, whereas internal latent image-forming silver halide grains, though capable of forming a negative image when developed in an internal developer, are usually employed with surface developers to form direct-positive images. The distinction between surface latent image and internal latent image silver halide grains is generally well recognized in the art. Generally some additional ingredient or step is required in preparation to form silver halide grains capable of preferentially forming an internal latent image as compared to a surface latent image.

Although the difference between a negative image produced by a surface latent image emulsion and a positive image produced by an internal latent image emulsion when processed in a surface developer is a qualitative difference which is visually apparent to even the unskilled observer, a number of tests have been devised to distinguish quantitatively surface latent image-forming and internal latent image-forming emulsions. For example, according to one such test when the sensitivity resulting from surface development (A), described below, is greater than that resulting from internal development (B), described below, the emulsion being previously light exposed for a period of from 1 to 0.01 second, the emulsion is of a type which is "capable of forming a surface latent image" or, more succinctly, it is a surface latent image emulsion. The sensitivity is defined by the following equation:

$$S = \frac{100}{Eh}$$

in which S represents the sensitivity and Eh represents the quantity of exposure necessary to obtain a mean density—i.e., $\frac{1}{2}(D_{max}+D_{min})$.

Surface Development (A)

The emulsion is processed at 20° C. for 10 minutes in a developer solution of the following composition:

| | |
|---|---|
| N—methyl-p-aminophenol (hemisulfate) | 2.5 g |
| Ascorbic acid | 10 g |
| Sodium metaborate (with 4 molecules of water) | 35 g |
| Potassium bromide | 1 g |

-continued

| | |
|---|---|
| Water to bring the total to | 1 liter. |

Internal Development (B)

The emulsion is processed at about 20° C. for 10 minutes in a bleaching solution containing 3 g of potassium ferricyanide per liter and 0.0125 g of phenosafranine per liter and washed with water for 10 minutes and developed at 20° C. for 10 minutes in a developer solution having the following composition:

| | |
|---|---|
| N—methyl-p-aminophenol (hemisulfate) | 2.5 g |
| Ascorbic acid | 10 g |
| Sodium metaborate (with 4 moles of water) | 35 g |
| Potassium bromide | 1 g |
| Sodium thiosulfate | 3 g |
| Water to bring the total to | 1 liter. |

The silver halide grains, when the emulsions are used for lith applications, have a mean grain size of not larger than about 0.7 micron, preferably about 0.4 micron or less. Mean grain size is well understood by those skilled in the art, as illustrated by Mees and James, *The Theory of the Photographic Process,* 3rd Ed., MacMillan 1966, Chapter 1, pp. 36–43. The photographic emulsions of this invention are capable of producing higher photographic speeds than would be expected from their mean grain sizes. The photographic emulsions can be coated to provide emulsion layers in the photographic elements of any conventional silver coverage. Common conventional silver coating coverages fall within the range of from about 0.5 to about 10 grams per square meter.

As is generally recognized in the art, higher contrasts can be achieved by employing relatively monodispersed emulsions. Monodispersed emulsions are characterized by a large proportion of the silver halide grains falling within a relatively narrow size-frequency distribution. In quantitative terms, monodispersed emulsions have been defined as those in which 90 percent by weight or by number of the silver halide grains are within plus or minus 40 percent of the mean grain size.

Silver halide emulsions contain in addition to silver halide grains a binder. The proportion of binder can be widely varied, but typically is within the range of from about 20 to 250 grams per mole of silver halide. Excessive binder can have the effect of reducing maximum densities and consequently also reduce contrast. Thus for contrast values of 10 or more it is preferred that the binder be present in a concentration of 250 grams per mole of silver halide or less.

The binders of the emulsions can be comprised of hydrophilic colloids. Suitable hydrophilic materials include both naturally occurring substances such as proteins, protein derivatives, cellulose derivatives—e.g., cellulose esters, gelatin—e.g., alkali-treated gelatin (cattle bone or hide gelatin) or acid-treated gelatin (pigskin gelatin), gelatin derivatives—e.g., acetylated gelatin, phthalated gelatin and the like, polysaccharides such as dextran, gum arabic, zein, casein, pectin, collagen derivatives, collodion, agar-agar, arrowroot, albumin and the like as described in U.S. Pat. Nos. 2,614,928 and '929, to Yutzy et al., Lowe et at 2,691,582, 2,614,930, '931, 2,327,808 and 2,448,534, Gates et al 2,787,545 and 2,956,880, Himmelmann et al 3,061,436, Farrell et al 2,816,027, Ryan 3,132,945, 3,138,461 and 3,186,846, Dersch et al U.K. Pat. No. 1,167,159 and U.S. Pat. Nos.

2,960,405 and 3,436,220, Geary 3,486,896, Gazzard U.K. Pat. No. 793,549, to Gates et al U.S. Pat. Nos. 2,992,213, 3,157,506, 3,184,312 and 3,539,353, Miller et al 3,227,571, Boyer et al 3,532,502, Malan 3,551,151, Lohmer et al 4,018,609, to Luciani et al U.K. Pat. Nos. 1,186,790, 1,489,080 and Hori et al Belgian Pat. No. 856,631, U.K. Pat. Nos. 1,490,644, 1,483,551, Arase et al 1,459,906, to Salo U.S. Pat. Nos. 2,110,491 and 2,311,086, Fallesen 2,343,650, Yutzy 2,322,085, Lowe 2,563,791, Talbot et al 2,725,293, Hilborn 2,748,022, DePauw et al 2,956,883, Ritchie U.K. Pat. No. 2,095, DeStubner U.S. Pat. Nos. 1,752,069, Sheppard et al 2,127,573, Lierg 2,256,720, Gaspar 2,361,936, Farmer U.K. Pat. Nos. 15,727, Stevens 1,062,116 and Yamamoto et al U.S. Pat. No. 3,923,517.

In addition to hydrophilic colloids the emulsion binder can be optionally comprised of synthetic polymeric materials which are water insoluble or only slightly soluble, such as polymeric latices. These materials can act as supplemental grain peptizers and carriers, and they can also advantageously impart increased dimensional stability to the photographic elements. The synthetic polymeric materials can be present in a weight ratio with the hydrophilic colloids of up to 2:1. It is generally preferred that the synthetic polymer materials constitute from about 20 to 80 percent by weight of the binder.

Suitable synthetic polymer materials can be chosen from among poly(vinyl lactams), acrylamide polymers, polyvinyl alcohol and its derivatives, polyvinyl acetals, polymers of alkyl and sulfoalkyl acrylates and methacrylates, hydrolyzed polyvinyl acetates, polyamides, polyvinyl pyridine, acrylic acid polymers, maleic anhydride copolymers, polyalkylene oxides, methacrylamide copolymers, polyvinyl oxazolidinones, maleic acid copolymers, vinylamine copolymers, methacrylic acid copolymers, acryloyloxyalkylsulfonic acid copolymers, sulfoalkylacrylamide copolymers, polyalkyleneimine copolymers, polyamines, N,N-dialkylaminoalkyl acrylates, vinyl imidazole copolymers, vinyl sulfide copolymers, halogenated styrene polymers, amineacrylamide polymers, polypeptides and the like as described in Hollister et al U.S. Pat. Nos. 3,679,425, 3,706,564 and 3,813,251, Lowe 2,253,078, 2,276,322, '323, 2,281,703, 2,311,058 and 2,414,207, Lowe et al 2,484,456, 2,541,474 and 2,632,704, Perry et al 3,425,836, Smith et al 3,415,653 and 3,615,624, Smith 3,488,708, Whiteley et al 3,392,025 and 3,511,818, Fitzgerald 3,681,079, 3,721,565, 3,852,073, 3,861,918 and 3,925,083, Fitzgerald et al 3,879,205, Nottorf 3,142,568, Houck et al 3,062,674 and 3,220,844, Dann et al 2,882,161, Schupp 2,579,016, Weaver 2,829,053, Alles et al 2,698,240, Priest et al 3,003,879, Merrill et al 3,419,397, Stonham 3,284,207, Lohmer et al 3,167,430, Williams 2,957,767, Dawson et al 2,893,867, Smith et al 2,860,986 and 2,904,539, Ponticello et al 3,929,482 and 3,860,428, Ponticello 3,939,130, Dykstra 3,411,911 and Dykstra et al Canadian Pat. No. 774,054, Ream et al U.S. Pat. No. 3,287,289, Smith U.K. Pat. Nos. 1,466,600, Stevens 1,062,116, Fordyce U.S. Pat. Nos. 2,211,323, Martinez 2,284,877, Watkins 2,420,455, Jones 2,533,166, Bolton 2,495,918, Graves 2,289,775, Yackel 2,565,418, Unruh et al 2,865,893 and 2,875,059, Rees et al 3,536,491, Broadhead et al U.K. Pat. No. 1,348,815, Taylor et al U.S. Pat. Nos. 3,479,186, Merrill et al 3,520,857, Bacon et al 3,690,888, Bowman 3,748,143, Dickinson et al U.K. Pat. Nos. 808,227 and 808,228, Wood 822,192 and Iguchi et al 1,398,055.

Although the term "binder" is employed in describing the continuous phase of the silver halide emulsions, it is recognized that other terms commonly employed by those skilled in the art, such as carrier or vehicle, can be interchangeably employed. The binders described in connection with the emulsions are also useful in forming undercoating layers, interlayers and overcoating layers of the photographic elements of this invention. Typically the binders are hardened with one or more photographic hardeners, such as those described in Paragraph VII, *Product Licensing Index,* Vol. 92, December 1971, Item 9232, here incorporated by reference.

Emulsions according to this invention having silver halide grains of any conventional geometric form (e.g., regular cubic or octahedral crystalline form) can be prepared by a variety of techniques—e.g., single-jet, double-jet (including continuous removal techniques), accelerated flow rate and interrupted precipitation techniques, as illustrated by Trivelli and Smith, *The Photographic Journal,* Vol. LXXIX, May, 1939, pp. 330–338, T. H. James, *The Theory of the Photographic Process,* 4th Ed., Macmillan, 1977, Chapter 3, Terwilliger et al *Research Disclosure,* Vol. 149, September 1976, Item 14987, as well as Nietz et al U.S. Pat. No. 2,222,264, Wilgus German OLS No. 2,107,118, Lewis U.K. Pat. Nos. 335,925, 1,430,465 and 1,469,480, Irie et al U.S. Pat. Nos. 3,650,757, Kurz 3,672,900, Morgan 3,917,485, Musliner 3,790,387, Evans 3,761,276 and Gilman et al 3,979,213. Double jet accelerated flow rate precipitation techniques are preferred for forming monodispersed emulsions. Sensitizing compounds, such as compounds of copper, thallium, cadmium, rhodium, tungsten, thorium, iridium and mixtures thereof, can be present during precipitation of the silver halide emulsion, as illustrated by Arnold et al U.S. Pat. Nos. 1,195,432, Hochstetter 1,951,933, Overman 2,628,167, Mueller et al 2,950,972, Sidebotham 3,488,709 and Rosecrants et al 3,737,313.

The individual reactants can be added to the reaction vessel through surface or sub-surface delivery tubes by gravity feed or by delivery apparatus for maintaining control of the pH and/or pAg of the reaction vessel contents, as illustrated by Culhane et al U.S. Pat. Nos. 3,821,002, Oliver 3,031,304 and Claes et al, *Photographische Korrespondenz,* 102 Band, Number 10, 1967, p. 162. In order to obtain rapid distribution of the reactants within the reaction vessel, specially constructed mixing devices can be employed, as illustrated by Audran U.S. Pat. Nos. 2,996,287, McCrossen et al 3,342,605, Frame et al 3,415,650, Porter et al 3,785,777, Saito et al German OLS Nos. 2,556,885 and Sato et al German OLS 2,555,364. An enclosed reaction vessel can be employed to receive and mix reactants upstream of the main reaction vessel, as illustrated by Forster et al U.S. Pat. Nos. 3,897,935 and Posse et al 3,790,386.

The grain size distribution of the silver halide emulsions can be controlled by silver halide grain separation techniques or by blending silver halide emulsions of differing grain sizes. The emulsions can include ammoniacal emulsions, as illustrated by Glafkides, *Photographic Chemistry,* Vol. 1, Fountain Press, London, 1958, pp. 365–368 and pp. 301–304; thiocyanate ripened emulsions, as illustrated by Illingsworth U.S. Pat. No. 3,320,069; thioether ripened emulsions, as illustrated by McBride U.S. Pat. Nos. 3,271,157, Jones 3,574,628 and Rosecrants et al 3,737,313 or emulsions containing weak silver halide solvents, such as ammonium salts, as illustrated by Perignon U.S. Pat. No. 3,784,381 and *Research Disclosure,* Vol. 134, June 1975, Item 13452.

The silver halide emulsion can be unwashed or washed to remove soluble salts. The soluble salts can be removed by chill setting and leaching, as illustrated by Craft U.S. Pat. Nos. 2,316,845 and McFall et al 3,396,027; by coagulation washing, as illustrated by Hewitson et al U.S. Pat. Nos. 2,618,556, Yutzy et al 2,614,928, Yackel 2,565,418, Hart et al 3,241,969, Waller et al 2,489,341, Klinger U.K. Pat. Nos. 1,305,409 and Dersch et al 1,167,159; by centrifugation and decantation of a coagulated emulsion, as illustrated by Murray U.S. Pat. Nos. 2,463,794, Ujihara et al 3,707,378, Audran 2,996,287 and Timson 3,498,454; by employing hydrocyclones alone or in combination with centrifuges, as illustrated by U.K. Pat. Nos. 336,692, Claes U.K. Pat. No. 1,356,573 and Ushomirskii et al *Soviet Chemical Industry,* Vol. 6, No. 3, 1974, pp. 181–185; by diafiltration with a semipermeable membrane, as illustrated by *Research Disclosure,* Vol. 102, October 1972, Item 10208, Hagemaier et al *Research Disclosure,* Vol. 131, March 1975, Item 13122, Bonnet *Research Disclosure,* Vol. 135, July 1975, Item 13577, Berg et al German OLS No. 2,436,46and Bolton U.S. Pat. No. 2,495,918 or by employing an ion exchange resin, as illustrated by Maley U.S. Pat. Nos. 3,782,953 and Noble 2,827,428. The emulsions, with or without sensitizers, can be dried and stored prior to use as illustrated by *Research Disclosure,* Vol. 101, September 1972, Item 10152.

The silver halide emulsions can be chemically sensitized with active gelatin, as illustrated by T. H. James, *The Theory of the Photographic Process,* 4th Ed., Macmillan, 1977, pp. 67–76, or with sulfur, selenium, tellurium, platinum, palladium, iridium, osmium, rhenium or phosphorus sensitizers or combinations of these sensitizers, such as at pAg levels of from 5 to 10, pH levels of from 5 to 8 and temperatures of from 30°to 80° C., as illustrated by *Research Disclosure, Vol.* 134, June 1975, Item 13452, Sheppard et al U.S. Pat. Nos. 1,623,499, McVeigh 3,297,447, Dunn 3,297,446, Berry et al Patent 3,772,031, Gilman et al 3,761,267, Ohi et al 3,857,711, Klinger et al 3,565,633 and Oftedahl 3,901,714 and 3,904,415. Additionally or alternatively, the emulsions can be reduction sensitized—e.g., with hydrogen, as illustrated by Janusonis U.S. Pat. Nos. 3,891,446 and Babcock et al 3,984,249, by low pAg (e.g., less than 5) high pH (e.g., greater than 8) treatment or through the use of reducing agents, such as stannous chloride, thiourea dioxide, polyamines and amineboranes, as illustrated by Allen et al U.S. Pat. No. 2,983,609, Oftedahl et al *Research Disclosure,* Vol. 136, August 1975, Item 13654, Lowe et al U.S. Pat. Nos. 2,518,698 and 2,743,182, Chambers et al 3,026,203 and Bigelow et al 3,361,564. Generally sulfur sensitization is the preferred chemical sensitization for the emulsions. The emulsions need not be chemically sensitized, however, in order to exhibit the advantages of this invention.

The silver halide emulsions can be spectrally sensitized with dyes from a variety of classes, including the polymethine dye class, which includes the cyanines, merocyanines, complex cyanines and merocyanines (i.e., tri-, tetra- and poly-nuclear cyanines and merocyanines), oxonols, hemioxonols, styryls, merostyryls and streptocyanines.

The cyanine spectral sensitizing dyes include, joined by a methine linkage, two basic heterocyclic nuclei, such as those derived from quinolinium, pyridinium, isoquinolinium, 3H-indolium, benz[e]indolium, oxazolium, thiazolium, selenazolinium, imidazolium, benzoxazolinium, benzothiazolium, benzoselenazolium, benzimidazolium, naphthoxazolium, naphthothiazolium, naphthoselenazolium, thiazolinium dihydronaphthothiazolium, pyrylium and imidazopyrazinium quaternary salts.

The merocyanine spectral sensitizing dyes include, joined by a methine linkage, a basic heterocyclic nucleus of the cyanine dye type and an acidic nucleus, such as can be derived from barbituric acid, 2-thiobarbituric acid, rhodanine, hydantoin, 2-thiohydantoin, 4-thiohyantoin, 2-pyrazolin-5-one, 2-isoxazolin-5-one, indan-1,3-dione, cyclohexan-1,3-dione, 1,3-dioxan-4,6-dione, pyrazolin-3,5-dione, pentan-2,4-dione, alkylsulfonyl acetonitrile, malononitrile, isoquinolin-4-one, and chroman-2,4-dione.

One or more spectral sensitizing dyes may be used. Dyes with sensitizing maxima at wavelengths throughout the visible spectrum and with a great variety of spectral sensitivity curve shapes are known. The choice and relative proportions of dyes depends upon the region of the spectrum to which sensitivity is desired and upon the shape of the spectral sensitivity curve desired. Dyes with overlapping spectral sensitivity curves will often yield in combination a curve in which the sensitivity at each wavelength in the area of overlap is approximately equal to the sum of the sensitivities of the individual dyes. Thus, it is possible to use combinations of dyes with different maxima to achieve a spectral sensitivity curve with a maximum intermediate to the sensitizing maxima of the individual dyes.

Combinations of spectral sensitizing dyes can be used which result in supersensitization—that is, spectral sensitization that is greater in some spectral region than that from any concentration of one of the dyes alone or that which would result from the additive effect of the dyes. Supersensitization can be achieved with selected combinations of spectral sensitizing dyes and other addenda, such as stabilizers and antifoggants, development accelerators or inhibitors, coating aids, brighteners and antistatic agents. Any one of several mechanisms as well as exemplary compounds which can be responsible for supersensitization are discussed by Gilman, *Photographic Science and Engineering,* Vol. 18, 1974, pp. 418–430.

Examples of useful spectral sensitizing dyes for sensitizing silver halide emulsions are found in U.K. Pat. No. 742,112, Brooker U.S. Pat. Nos. 1,846,300, '301, '302, '303, '304, 2,078,233 and 2,089,729, Brooker et al 2,165,338, 2,213,238, 2,493,747, 2,493,748, 2,526,632, 2,739,964 (Reissue 24,292), 2,778,823, 2,917,516, 3,352,857, 3,411,916 and 3,431,111, Sprague 2,503,776, Nys et al 3,282,933, Riester 3,660,102, Kampfer et al 3,660,103, Taber et al 3,335,010, 3,352,680 and 3,384,486, Lincoln et al 3,397,981, Fumia et al 3,482,978 and 3,623,881, Spence et al 3,718,470 and Mee 4,025,349. Examples of useful supersensitizing dye combinations, of non-light absorbing addenda which function as supersensitizers or of useful dye combinations are found in McFall et al U.S. Pat. Nos. 2,933,390, Jones et al 2,937,089, Motter 3,506,443 and Schwan et al 3,672,898.

By suitable choice of substituent groups the dyes can be cationic, anionic or nonionic. Preferred dyes are cationic cyanine and merocyanine dyes. Emulsions containing cyanine and merocyanine dyes have been observed to exhibit relatively high contrasts. Spectral sensitizing dyes specifically preferred for use in the practice of this invention are as follows:

SS-1: Anhydro-5,5'-dichloro-9-ethyl-3,3'-bis(3-sulfopropyl)oxacarbocyanine hydroxide, sodium salt SS-2: 5,5',6,6'-Tetrachloro-1,1',3,3'-tetraethylbenzimidazolocarbocyanine iodide SS-3: 3,3'-Diethyl-9-methylthiacarbocyanine bromide SS-4: 3,3'-Diethyloxacarbocyanine iodide SS-5: 5,5'-Dichloro-3,3',9-triethylthiacarbocyanine bromide SS-6: 3,3'-Diethylthiocarbocyanine iodide SS-7: 5,5'-Dichloro-2,2'-diethylthiocarbocyanine, p-toluene sulfonate salt SS-8: 3-Carboxymethyl-5-[(3-methyl-2-thiazolidinylidene)-1-methylethylidene]rhodanine SS-9: 3-Ethyl-3-[(3-ethyl-2-thiazolidinylidene)-1-methylethylidene]rhodanine SS-10: 5-[(3-(2-Carboxyethyl}-2-thiazolidinylidene)ethylidene]-3-ethylrhodanine SS-11: 1-Carboxymethyl-5-[(3-ethyl-2-benzothiazolinylidene)ethylidene]-3-phenyl-2-thiohydantoin SS-12: 1-Carboxymethyl-5-[(l-ethyl-2(H)-naphtho[1,2-d]thiazolin-2-ylidene)ethylidene]3-phenyl-2-thiohydantoin SS-13: 3-Carboxymethyl-5-[(3-ethyl-2-benzothiazolinylidene)ethylidene]rhodanine SS-14: 5-[(3-Ethyl-2-benzoxazolinylidene)ethylidene]-3-heptyl-2-thio-2,4-oxazolidinedione SS-15: 3-Carboxymethyl-5-(3-ethyl-2-benzothiazolinylidene)rhodanine SS-16: 3-Carboxymethyl-5-(3-methyl-2-benzoxazolinylidene)rhodanine SS-17: 3-Ethyl-5-[(3-ethyl-2-benzoxazolinylidene)ethylidene]rhodanine The photographic elements can be protected against fog by incorporation of antifoggants and stabilizers in the element itself or in the developer in which the element is to be processed. Illustrative of conventional antifoggants and stabilizers useful for this purpose are those disclosed by Paragraph V, *Product Licensing Index,* Vol. 92, December 1971, Item 9232, here incorporated by reference.

It has been observed that both fog reduction and an increase in contrast are obtainable by employing benzotriazole antifoggants either in the photographic element or developer in which the element is processed. The benzotriazole can be located in the emulsion layer or in any other hydrophilic colloid layer of the photographic element in a concentration in the range of from $10^{-4}$ to $10^{-1}$, preferably $10^{-3}$ to $3\times10^{-2}$, mole per mole of silver. When the benzotriazole antifoggant is added to the developer, it is employed in a concentration of from $10^{-6}$ to about $10^{-1}$, preferably $3\times10^{-5}$ and $3\times10^{-2}$, mole per liter of developer.

Useful benzotriazoles can be chosen from among conventional benzotriazole antifoggants, such as those disclosed by Land U.S. Pat. Nos. 2,704,721 and Rogers et al 3,265,498, here incorporated by reference. The preferred benzotriazoles for use in this invention are benzotriazole (that is, the unsubstituted benzotriazole compound), halo-substituted benzotriazoles (e.g., 5-chlorobenzotriazole, 4-bromobenzotriazole and 4-chlorobenzotriazole) and alkyl-substituted benzotriazoles wherein the alkyl moiety contains from about 1 to 12 carbon atoms (e.g., 5-methylbenzotriazole). The use of 5-methylbenzo(e.g., triazole as an antifoggant is illustrated by Baldassari et al U.S. Pat. No. 3,925,086.

In addition to the components of the photographic emulsions and other hydrophilic colloid layers described above it is appreciated that other conventional element addenda compatible with obtaining relatively high contrast images can be present. For example, the photographic elements can contain developing agents (described below in connection with the processing steps), development modifiers, plasticizers and lubricants, coating aids, antistatic materials, matting agents, brighteners and color materials, these conventional materials being illustrated in Paragraphs IV, VI, IX, XII, XIII, XIV and XXII of *Product Licensing Index,* Vol. 92, December 1971, Item 9232, here incorporated by reference.

The hydrazine compounds, sensitizing dyes and other addenda incorporated into the layers of the photographic elements can be dissolved and added prior to coating either from water or organic solvent solutions, depending upon the solubility of the addenda. Ultrasound can be employed to dissolve addenda, as illustrated by Owen et al U.S. Pat. Nos. 3,485,634 and Salminen 3,551,157. Semipermeable and ion exchange membranes can be used to introduce addenda, such as water soluble ions (e g., chemical sensitizers). Hydrophobic addenda, particularly those which need not be adsorbed to the silver halide grain surfaces to be effective, such as couplers, redox dye-releasers and the like, can be mechanically dispersed directly, as illustrated by Belgian Pat. No. 852,138, or in high boiling (coupler) solvents, as illustrated by Jelley et al U.S. Pat. Nos. 2,322,027 and Fierke et al 2,801,171, or the hydrophobic addenda can be loaded into latices and dispersed, as illustrated by Chen *Research Disclosure,* Vol. 159, July 1977, Item 15930.

Exemplary apparatus and procedures for introducing and blending addenda are illustrated by Johnson et al U.S. Pat. Nos. 3,425,835, 3,570,818, 3,773,302 and 3,850,643, McCrossen et al 3,342,605, Collins et al 2,912,343 and Terwilliger et al 3,827,888 and 3,888,465.

In forming photographic elements the layers can be located on photographic supports by various procedures, including immersion or dip coating, roller coating, reverse roll coating, air knife coating, doctor blade coating, gravure coating, spray coating, extrusion coating, bead coating, stretch-flow coating and curtain coating. High speed coating using a pressure differential is illustrated by Beguin U.S. Pat. No. 2,681,294. Controlled variation in the pressure differential to facilitate coating starts is illustrated by Johnson U.S. Pat. No. 3,220,877 and to minimize splicing disruptions is illustrated by Fowble U.S. Pat. No. 3,916,043. Coating at reduced pressures to accelerate drying is illustrated by Beck U.S. Pat. No. 2,815,307. Very high speed curtain coating is illustrated by Greiller U.S. Pat. No. 3,632,374. Two or more layers can be coated simultaneously, as illustrated by Russell U.S. Pat. Nos. 2,761,791, Wynn 2,941,898, Miller et al 3,206,323, Bacon et al 3,425,857, Hughes 3,508,947, Herzhoff et al U.K. Pat. No. 1,208,809, Herzhoff et al U.S. Pat. Nos. 3,645,773 and Dittman et al 4,001,024. In simultaneous multilayer coating varied coating hoppers can be used, as illustrated by Russell et al U.S. Pat. Nos. 2,761,417, Russell 2,761,418 and 3,474,758, Mercier et al 2,761,419, Wright 2,975,754, Padday 3,005,440, Mercier 3,627,564, Timson 3,749,053S and 3,958,532, Jackson 3,993,019 and Jackson et al 3,996,885. Silver halide layers can also be coated by vacuum evaporation, as illustrated by Lu Valle et al U.S. Pat. Nos. 3,219,444 and 3,219,451.

The layers of the photographic elements can be coated on a variety of supports. Typical photographic supports include polymeric film, wood fiber—e.g., paper, metallic sheet and foil, glass and ceramic supporting elements provided with one or more subbing layers to enhance the adhesive, antistatic, dimensional, abrasive, hardness, frictional, antihalation and/or other properties of the support surface.

Typical of useful polymeric film supports are films of cellulose nitrate and cellulose esters such as cellulose triacetate and diacetate, polystyrene, polyamides, homo- and co-polymers of vinyl chloride, poly(vinyl acetal), polycarbonate, homo- and co-polymers of olefins, such as polyethylene and polypropylene, and polyesters of dibasic aromatic carboxylic acids with divalent alcohols, such as poly(ethylene terephthalate).

Typical of useful paper supports are those which are partially acetylated or coated with baryta and/or a polyolefin, particularly a polymer of an α-olefin containing 2 to 10 carbon atoms, such as polyethylene, polypropylene, copolymers of ethylene and propylene and the like.

Polyolefins, such as polyethylene, polypropylene and polyallomers—e.g., copolymers of ethylene with propylene, as illustrated by Hagemeyer et al U.S. Pat. No. 3,478,128, are preferably employed as resin coatings over paper, as illustrated by Crawford et al U.S. Pat. Nos. 3,411,908 and Joseph et al 3,630,740, over polystyrene and polyester film supports, as illustrated by Crawford et al U.S. Pat. No. 3,630,742, or can be employed as unitary flexible reflection supports, as illustrated by Venor et al U.S. Pat. No. 3,973,963.

Preferred cellulose ester supports are cellulose triacetate supports, as illustrated by Fordyce et al U.S. Pat. Nos. 2,492,977, 2,492,978 and 2,739,069, as well as mixed cellulose ester supports, such as cellulose acetate propionate and cellulose acetate butyrate, as illustrated by Fordyce et al U.S. Pat. No. 2,739,070.

Preferred polyester film supports are comprised of linear polyester, such as illustrated by Alles et al U.S. Pat. Nos. 2,627,088, Wellman 2,720,503, Alles 2,779,684 and Kibler et al 2,901,466. Polyester films can be formed by varied techniques, as illustrated by Alles, cited above, Czerkas et al U.S. Pat. Nos. 3,663,683 and Williams et al 3,504,075, and modified for use as photographic film supports, as illustrated by Van Stappen U.S. Pat. Nos. 3,227,576, Nadeau et al 3,501,301, Reedy et al 3,589,905, Babbitt et al 3,850,640, Bailey et al 3,888,678, Hunter 3,904,420 and Mallinson et al 3,928,697. Polyester film supports are generally preferred for fine line reproduction applications in view of their superior dimensional stability.

The photographic elements can be imagewise exposed with various forms of energy, which encompass the ultraviolet and visible (e.g., actinic) and infrared regions of the electromagnetic spectrum as well as electron beam and beta radiation, gamma ray, X-ray, alpha particle, neutron radiation and other forms of corpuscular and wavelike radiant energy in either noncoherent (random phase) forms or coherent (in phase) forms, as produced by lasers. Exposures can be monochromatic, orthochromatic or panchromatic. Imagewise exposures at ambient, elevated or reduced temperatures and/or pressures, including high or low intensity exposures, continuous or intermittent exposures, exposure times ranging from minutes to relatively short durations in the millisecond to microsecond range and solarizing exposures, can be employed within the useful response ranges determined by conventional sensitometric techniques, as illustrated by T. H. James, *The Theory of the Photographic Process,* 4th Ed., Macmillan, 1977, Chapters 4, 6, 17, 18 and 23.

The light-sensitive silver halide contained in the photographic elements can be processed following exposure to form a visible image by associating the silver halide with an aqueous alkaline medium in the presence of a developing agent contained in the medium or the element. Processing formulations and techniques are described in L. F. Mason, *Photographic Processing Chemistry.* Focal Press, London, 1966; *Processing Chemicals and Formulas,* Publication J-1, Eastman Kodak Company, 1973; *Photo-Lab Index,* Morgan and Morgan, Inc., Dobbs Ferry, New York, 1977, and *Neblette's Handbook of Photography and Reprography—Materials, Processes and Systems,* VanNostrand Reinhold Company, 7th Ed., 1977.

It is a distinct advantage of the present invention that the photographic elements can be processed in conventional developers generally as opposed to specialized developers conventionally employed in conjunction with lith photographic elements to obtain very high contrast images. When the photographic elements contain incorporated developing agents, the elements can be processed in an activator, which can be identical to the developer in composition, but lacking a developing agent. Very high contrast images can be obtained at pH values in the range of from 11 to 12.3, preferably 11.3 to 12.0. Higher pH levels can, of course, also be used, although storage stability of the developer is reduced. It is also an advantage of this invention that relatively high contrast images can be obtained with higher concentrations of preservatives to reduce aerial oxidation of the developing agents, such as alkali sulfites (e.g., sodium or potassium sulfite, bisulfite or metasulfite) than has heretofore been feasible. This allows the developers to be stored for longer periods. Any preservative or preservative concentration conventional in lower contrast processing can be employed, such as, for instance, a sulfite ion concentration in the range of from about 0.15 to 1.2 mole per liter of developer.

The developers are typically aqueous solutions, although organic solvents, such as diethylene glycol, can also be included to facilitate the solvency of organic components. The developers contain one or a combination of conventional developing agents, such as a polyhydroxybenzene, aminophenol, para-phenylenediamine, ascorbic acid, pyrazolidone, pyrazolone, pyrimidine, dithionite, hydroxylamine or other conventional developing agents. It is preferred to employ hydroquinone and 3-pyrazolidone developing agents in combination. The pH of the developers can be adjusted with alkali metal hydroxides and carbonates, borax and other basic salts. To reduce gelatin swelling during development, compounds such as sodium sulfate can be incorporated into the developer. Also, compounds such as sodium thiocyanate can be present to reduce granularity. Also, chelating and sequestering agents, such as ethylenediaminetetraacetic acid or its sodium salt, can be present. Generally, any conventional developer composition can be employed in the practice of this invention. Specific illustrative photographic developers are disclosed in the *Handbook of Chemistry and Physics,* 36th Edition, under the title "Photographic Formulae" at page 3001 *et seq.* and in *Processing Chemicals and Formulas.* 6th Edition, published by Eastman Kodak Company (1963), the disclosures of which are here incorporated by reference. The photographic elements can, of course, be processed with conventional developers for lith photographic elements, as illustrated by Masseth U.S. Pat. No. 3,573,914 and VanReusel U.K. Pat. No. 376,600.

*Product Licensing Index* and *Research Disclosure* are published by Industrial Opportunities Ltd., Homewell, Havant, Hampshire, PO9, IEF, United Kingdom.

The invention can be further described by the examples illustrated below.

BRIEF DESCRIPTION OF THE DRAWING

The drawing shows the sensitometric results of Example 15.

EXAMPLE 1 A 0.4 micron cubic silver bromide emulsion which was not intentionally chemically sensitized was coated on a polyester film support at 4.30 g/m$^2$ silver and 4.79 g/m$^2$ gelatin (Coating I). A second coating was prepared with the nucleating agent 1-formyl-2-{4-[2-(2,4-di-tert-pentylphenoxy)-butyramido]phenyl})hydrazine (D-1) present in the emulsion layer at 500 mg/mole silver (Coating II). A third coating was prepared with the emulsion spectrally sensitized with 3-carboxymethyl-5-[(3-methyl-2-thiazolidinylidene)-1-methylethylidene]rhodanine (SS-8) at 100 mg/mole silver (Coating III). A fourth coating was prepared with the emulsion spectrally sensitized with SS-8 at 100 mg/mole silver and with the nucleating agent D-1 present in the emulsion layer at 500 mg/mole silver (Coating IV). The coatings were exposed for 1/5" to a 500 watt 3000° K tungsten light source and processed 60" in Developer C (pH 12.0, 30° C.) containing 75 g/l of sodium sulfite and 0.8 g/l of 5-methylbenzotriazole.

TABLE I

| Developer C | |
|---|---|
| 40.0 g | Hydroquinone |
| 0.4 g | 4,4-Dimethyl-1-phenyl-3-pyrazolidone |
| 0.8 g | 5-Methylbenzotriazole |
| 3.0 g | NaBr |
| 14.5 g | KOH |
| 7.0 g | $NaHCO_3$ |
| 1.0 g | Ethylenediamine tetraacetic acid, sodium salt |
| 75.0 g | $Na_2SO_3$ |
| Adjust pH with KOH | |

TABLE I-continued

| Developer C |
|---|
| Distilled water to 1 liter |

EXAMPLE 2

Coatings V–VIII were prepared similarly to coatings I–IV of Example 1 with the exception that the emulsion was a 0.4 micron cubic silver bromoiodide containing 2.5 molar percent iodide.

EXAMPLE 3

Coatings IX–XII were prepared similarly to coatings I–IV of Example 1 with the exception that the emulsion was a 0.4 micron octahedral silver bromide.

EXAMPLE 4

Coatings XIII–XVI were prepared similarly to coatings I–IV of Example 1 with the exception that the emulsion was a 0.4 micron cubic silver chloride. Development time was for 30 seconds.

In Table II is tabulated the sensitometric response of coatings I–XVI. For each emulsion, the relative speed of the control coating was normalized to a value of 100. As can be seen, for all emulsion types the presence of nucleating agent D-1 in the emulsion layer at 500 mg/mole silver resulted in an increase in speed over the control. Also, the photographic response was enhanced by the use of a spectral sensitizer, SS-8, in combination with the nucleating agent. This resulted in a large increase in speed plus a sharp rise in contrast. For the cubic silver bromide, silver bromoiodide, and silver chloride emulsions the increase was 1020, 2240, and 2090 relative speed units, respectively. Also, for each of these emulsions the contrast increased by a factor of over three times.

Examples 5–8 demonstrate the sensitometric advantages of incorporated nucleating agents when used in a negative working emulsion system over a stable range of development conditions. In Examples 7 and 8, it is shown that increased speed and high contrast are obtained in a developer range of pH 11.5 to 12.0. In Examples 7 and 8 it is shown that increased speed and high contrast are also obtained in a time of development span of 60 to 120 seconds. For each development condition the relative speed of the control coating was normalized to 100.

TABLE II

Effect of Nucleating Agent on Various Emulsion Types

| Coating No. | Emulsion | Nucleating Agent | Dye | Relative Speed | Contrast | $D_{min}$ |
|---|---|---|---|---|---|---|
| I | 0.4 micron cube AgBr | — | — | 100 | 5.1 | .03 |
| II | 0.4 micron cube AgBr | D-1 | — | 148 | 4.6 | .03 |
| III | 0.4 micron cube AgBr | — | SS-8 | 372 | 6.5 | .05 |
| IV | 0.4 micron cube AgBr | D-1 | SS-8 | 1120 | >16.0 | .07 |
| V | 0.4 micron cube AgBrI | — | — | 100 | 4.9 | .03 |
| VI | 0.4 micron cube AgBrI | D-1 | — | 200 | 4.7 | .03 |
| VII | 0.4 micron cube AgBrI | — | SS-8 | 692 | 8.6 | .05 |
| VIII | 0.4 micron cube AgBrI | D-1 | SS-8 | 2340 | >16.0 | .09 |
| IX | 0.4 micron octa AgBr | — | — | 100 | 4.8 | .04 |
| X | 0.4 micron octa AgBr | D-1 | — | 145 | 4.9 | .05 |
| XI | 0.4 micron octa AgBr | — | SS-8 | 389 | 7.6 | .06 |
| XII | 0.4 micron octa AgBr | D-1 | SS-8 | 1180 | 9.4 | .06 |
| XIII | 0.4 micron cube AgCl | — | — | 100* | 3.0 | .05 |
| XIV | 0.4 micron cube AgCl | D-1 | — | 112* | 3.3 | .05 |
| XV | 0.4 micron cube AgCl | — | SS-8 | 1230* | 7.3 | .07 |
| XVI | 0.4 micron cube AgCl | D-1 | SS-8 | 2190* | 9.7 | .09 |

*30" Development time

EXAMPLE 5

A 0.4 micron cubic AgBr emulsion similar to that of Example 1 was spectrally sensitized with SS-8 at 100 mg/mole Ag and coated on a polyester film support at 4.30 g/m$^2$ silver and 4.79 g/m$^2$ gelatin (Coating XVII). Coating XVIII was similarly prepared, but in addition contained the nucleating agent 1-formyl-2-phenylhydrazine (D-2) in the emulsion layer at $10^{-2}$ moles/mole silver. Coating XIX contained the nucleating agent 1-formyl-2-(4-methoxyphenyl)hydrazine (D-3) at $10^{-2}$ moles/mole silver. The coatings were exposed for 1/5" to a 500 watt 3000° K tungsten light source and processed 60" in a developer similar to that of Example 1 (pH 11.5, 20° C.) containing 75 g/l of sodium sulfite and 0.8 g/l of 5-methylbenzotriazole As shown in Table III, at developer pH 11.5 increased speed and high contrast were attained by incorporating either nucleating agent D-2 or D-3 into the emulsion layer.

TABLE III

Effect of Incorporated Nucleating Agents at Developer pH 11.5 and 12.0

| Coating No. | Developer pH | Nucleating Agent | Dye | Relative Speed | Contrast | $D_{min}$ |
|---|---|---|---|---|---|---|
| XVII | 11.5 | — | SS-8 | 100 | 7.5 | .03 |
| XVIII | 11.5 | D-2 | SS-8 | 182 | 10.0 | .03 |
| XIX | 11.5 | D-3 | SS-8 | 324 | 12.1 | .03 |
| XX | 12.0 | — | SS-8 | 100 | 7.4 | .03 |
| XXI | 12.0 | D-2 | SS-8 | 324 | 14.0 | .03 |
| XXII | 12.0 | D-4 | SS-8 | 355 | 12.5 | .03 |

EXAMPLE 6

Coatings XX–XXII were prepared similarly to those of Example 5. When developed at pH 12.0, Coating XXI containing nucleating agent D-2 resulted in high contrast and an increase in relative speed of 224 units over the control. Coating XXII containing nucleating agent 1-formyl-2-(4-chlorophenyl)hydrazine (D-4) resulted in high contrast and a relative speed increase of 255 units. The results are summarized in Table III.

EXAMPLE 7

A 0.4 micron cubic AgBr emulsion similar to that of Example 1 was spectrally sensitized with SS-8 at 100 mg/mole silver and coated on a polyester film support at 4.30 g/m$^2$ silver and 4.79 g/m$^2$ gelatin (Coating XXIII). The emulsion was coated with and without nucleating agent 1-formyl-2-(4-fluorophenyl)hydrazine (D-5), or 1-formyl-2-(2-chlorophenyl)hydrazine (D-6), present in the emulsion layer at 1500 mg/mole silver. The coatings were exposed for 1/5" to a 500 watt 3000° K tungsten light source and processed 60" in a developer similar to that of Example 1 containing 75 g/l of sodium sulfite and 0.8 g/l of 5-methylbenzotriazole. As shown in Table IV, increased contrast and more than a 140 relative speed unit increase was realized by incorporating either D-5 (Coating XXIV) or D-6 (Coating XXV) into the emulsion layer.

EXAMPLE 8

Coatings XXVI–XXVIII were prepared similarly to the coatings of Example 7 and processed for 120" in developer similar to that of Example 1 containing 75 g/l of sodium sulfite and 0.8 g/l of 5-methylbenzotriazole. As shown in Table IV, for 120" development increased contrast and more than a 180 relative speed unit increase was realized by incorporating either D-5 (Coating XXVII) or D-6 (Coating XXVIII) into the emulsion layer.

TABLE IV

Effect of Incorporated Nucleating Agents at 60" and 120" Development Time

| Coating No. | Development Time | Nucleating Agent | Dye | Relative Speed | Contrast | $D_{min}$ |
|---|---|---|---|---|---|---|
| XXIII | 60" | — | SS-8 | 100 | 6.7 | .03 |
| XXIV | 60" | D-5 | SS-8 | 263 | 9.5 | .03 |
| XXV | 60" | D-6 | SS-8 | 240 | 10.5 | .03 |
| XXVI | 120" | — | SS-8 | 100 | 7.3 | .03 |
| XXVII | 120" | D-5 | SS-8 | 282 | 10.5 | .03 |
| XXVIII | 120" | D-6 | SS-8 | 295 | 10.5 | .03 |

EXAMPLE 9

A 0.4 micron cubic AgBr emulsion similar to that of Example 1 was divided into parts A, B, and C. Part A was not chemically sensitized, but was spectrally sensitized with SS-8 at 100 mg/mole silver, and coated on a polyestar film support at 4.30 g/m$^2$ silver and 4.79 g/m$^2$ gelatin. The emulsion was coated with the nucleating agent D-1 present in the emulsion layer at 500 mg/mole silver. Part B was given a mild reduction sensitization prior to spectral sensitization with SS-8 and the addition of the nucleating agent D-1. Part C was sulfur sensitized with 1 mg of sodium thiosulfate/mole silver prior to spectral sensitization with SS-8 and the addition of the nucleating agent D-1. Parts A, B and C were used to form coatings XXIX, XXX and XXXI, respectively. The coatings were exposed for 1/5" to a 500 watt 3000° K tungsten light source and processed 38" in a developer similar to that of Example 1 (pH 12.0, 30° C.) containing 75 g/l of sodium sulfite and 0.8 g/l of 5-methylbenzotriazole. As can be seen in Table V, increased speed and higher contrasts were obtained by both the mild reduction and sulfur sensitizations. The mild chemical sensitizations permit lower development times to be employed.

TABLE V

Effect of Chemical Sensitization

| Coating No. | Sensitization | Nucleating Agent | Dye | Relative Speed | Contrast | $D_{min}$ |
|---|---|---|---|---|---|---|
| XXIX | — | D-1 | SS-8 | 100 | 8.5 | .04 |
| XXX | Reduction* | D-1 | SS-8 | 135 | 15.3 | .08 |
| XXXI | Sulfur** | D-1 | SS-8 | 129 | 14.7 | .03 |

*Reduction Sensitization
**Sulfur Sensitization

EXAMPLE 10

A 0.4 micron cubic AgBr emulsion not chemically sensitized was coated on a polyester film support at 4.30 g/m$^2$ silver and 4.79 g/m$^2$ gelatin. The coating contained nucleating agent D-1 at 500 mg/mole silver and spectral sensitizer SS-8 at 100 mg/mole silver (Coating XXXII). A second coating was prepared which contained in addition to nucleating agent D-1 and spectral sensitizer SS-8, a latex polymer poly(methyl acrylate-co-3-acryloyloxypropane-1-sulfonic acid, sodium salt-co-2-acetoacetoxyethyl methacrylate) (91:5:4 wt. ratio) at 10 g/mole silver (Coating XXXIII). The coatings were exposed for 1/5" to a 500 watt 3000° K tungsten light source and processed 68" in a developer similar to that of Example 1 (pH 12.0, 30° C.) containing 75 g/l of sodium sulfite and 0.8 g/l of 5-methylbenzotriazole.

The addition of latex polymer to the coating element resulted in improved physical properties by giving greater dimensional stability to the coating.

EXAMPLE 11

A 0.4 micron cubic AgBr emulsion not chemically sensitized was coated on a polyester film support at 4.30 g/m$^2$ silver and 4.79 g/m$^2$ gelatin. The coating contained nucleating agent D-1 at 500 mg/mole silver and Dye SS-8 at 100 mg/mole silver (Coating XXXIV). A second coating was prepared with the exception that spectral sensitizer anhydro-5,5'-dichloro-9-ethyl-3,3'-bis-(3-sulfopropyl)oxacarbocyanine hydroxide, sodium salt (SS-1) at 216 mg/mole silver was used in place of SS-8 (Coating XXXV). The coatings were exposed for 1" to a 500 watt 3000° K tungsten light source and processed for 128" in a developer similar to that of Example 1 (pH 12.0, 30° C.) containing 75 g/l of sodium sulfite and 0.8 g/l of 5-methylbenzotriazole.

The use of SS-1 in place of SS-8 resulted in a lowering of $D_{min}$ of 0.03 to 0.04 density units.

EXAMPLE 12

The coatings of Example 11 were repeated with the exception that nucleating agent D-1 was coated at 1000 mg/mole silver and latex polymer poly(methyl acrylate-co-2-acrylamido-2-methylpropane sulfonic acid-co-2-acetoacetoxyethyl methacrylate) (89.6:3.7:6.7 wt. ratio) was added at 33.75 g/mole silver (Coatings XXXVI and XXXVII). The coatings were exposed for 1" to a 500 watt 3000° K tungsten light source and processed for 128" in a developer similar to that of Example 1 (pH 12.0, 30° C.) containing 75 g/l of sodium sulfite and 0.8 g/l of 5-methylbenzotriazole.

The addition of latex polymer to the coating element resulted in improved physical properties by giving greater dimensional stability to the coating.

EXAMPLE 13

A 0.35 micron cubic AgBrI emulsion was coated on a polyester film support at 4.30 g/m$^2$ silver and 4.79 g/m$^2$ gelatin. The coating contained nucleating agent D-1 at 1000 mg/mole silver, spectral sensitizer SS-1 at 216 mg/mole silver, and the latex polymer of Example 12 at 33.75 g/mole silver (Coating XXXVIII). A second coating was prepared which contained in addition to nucleating agent D-1, spectral sensitizer SS-8 and the latex polymer, a polyethylene glycol at 253 mg/mole silver (Coating XXXIX). The coatings were exposed for 1/5" to a 500 watt 3000° K tungsten light source and processed for 158" in a modified developer similar to that of Example 1 (pH 11.4, 32° C.) containing 75 g/l of sodium sulfite and 0.8 g/l of 5-methylbenzotriazole.

A speed increase of approximately 0.15 log E units was realized by adding the polyethylene glycol to the element as a development accelerator.

EXAMPLE 14

A 0.35 micron cubic AgBrI emulsion was coated on a polyester film support at 4.30 g/m$^2$ silver and 4.79 g/m$^2$ gelatin. The coating contained nucleating agent D-1 at 1000 mg/mole silver, spectral sensitizer SS-1 at 216 mg/mole silver, the latex polymer of Example 12 at 33.75 mg/mole silver, and a polyethylene glycol at 253 mg/mole silver (Coating XL). A second coating was prepared similar to Coating XL with 4-hydroxy-6-methyl-l,3,3a,7-tetraazindene present at 1 g/mole silver as a coating addendum (Coating XLI). The coatings were exposed for 1/5" to a 500 watt 3000° K tungsten light source and processed for 4' in a developer similar to that of Example 1 (pH 12.0, 35° C.) containing 75 g/l of sodium sulfite and 0.8 g/l of 5-methylbenzotriazole.

An increase of 0.10 log E speed units was obtained by adding 4-hydroxy-6-methyl-1,3,3a,7-tetraazindene to the coating element. Also, the coating was stable upon 1 week keeping at 49° C., 50 percent relative humidity.

EXAMPLE 15

A 0.35 micron cubic AgBrI emulsion was coated on a polyester film support at 4.30 g/m$^2$ silver and 4.79 g/m$^2$ gelatin. The coating contained spectral sensitizer SS-8 at 100 mg/mole silver (Coating XLII). Coating XLIII was prepared similar to Coating XLII except that nucleating agent N-chloro-N-pyridinoacetic acid carbohydrazide (D-8) (See Nucleating Agent 18, U.S. Pat. No. 2,419,975) was added to the element at 0.3 g/mole silver. Coating XLIV was similar to Coating XLII except that nucleating agent D-8 was present at 2.40 g/mole silver. Coating XLV was prepared similar to Coating XLII except that nucleating agent 4-(o-tolyl)-semicarbazide (D-9) (See Nucleating Agent 29, U.S. Pat. No. 2,419,975) was added to the element at 0.18 g/mole silver. Coating XLVI was similar to Coating XLII except that nucleating agent D-9 was present at 1.65 g/mole silver. Coating XLVII was prepared similar to Coating XLII except that nucleating agent D-1 was added to the element at 0.5 g/mole silver. The coatings were exposed for 1/5" to a 500 watt 3000° K tungsten light source and processed for 60" in a developer similar to that of Example 1 (pH 12.0, 30° C.) containing 75 g/l of sodium sulfite and 0.8 g/l of 5-methylbenzotriazole. The sensitometric results are given in the drawing.

As can be seen in the drawing, the pyridinium hydrazide and semicarbazide compounds (D-8 and D-9, respectively) showed increased speed and contrast when used at the higher concentrations (9.7 and $10\times10^{-3}$ mole per mole silver). At lower concentrations ($1.1\times10^{-3}$ mole per mole silver), the pyridinium hydrazide showed only slight increases in speed and contrast. The semicarbazide was slower than the control. Both were not as active as nucleating agent D-1 at $1.1\times10^{3}$ mole per mole silver.

EXAMPLE 16

A 0.4 micron cubic AgBr emulsion was spectrally sensitized with SS-8 at 100 mg/mole Ag and coated on a polyester film support at 4.30 g/m$^2$ silver and 4.79 g/m$^2$ gelatin (Coating XLVIII). Coating XLIX was prepared similar to Coating XLVIII with the exception that nucleating agent 1-formyl-2-(p-tolyl)hydrazine (D-7) at 1500 mg/mole silver was added to the coating element. The coatings were exposed for 1/5" to a 500 watt 3000° K tungsten light source and processed 60" in a developer similar to that of Example 1 (pH 11.5, 30° C.) containing 75 g/l of sodium sulfite and 0.8 g/l of 5-methylbenzotriazole.

As can be seen in Table VI, higher contrast and a 401 relative speed unit increase was obtained by adding nucleating agent D-7 to the coating element at $10^{-2}$ mole per mole silver.

TABLE VI

| Effect of Incorporated Nucleating Agents at Developer pH 11.5 | | | | | |
|---|---|---|---|---|---|
| Coating No. | Nucleating Agent | Dye | Relative Speed | Contrast | $D_{min}$ |
| XLVIII | — | SS-8 | 100 | 7.4 | 0.03 |
| XLIX | D-7 | SS-8 | 501 | 9.6 | 0.03 |

EXAMPLE 17

A 0.4 micron cubic AgBr emulsion was spectrally sensitized with SS-8 at 100 mg/mole Ag and coated on a polyester film support at 4.30 g/m$^2$ silver and 4.79 g/m$^2$ gelatin (Coating L). Coating LI was prepared similar to Coating L with the exception that nucleating agent D-1 was added to the element at 500 mg/mole silver.

TABLE VII

| Effect of Adding 5-Methylbenzotriazole (5-MBT) to the Element | | | | | | |
|---|---|---|---|---|---|---|
| Coating No. | Nucleating Agent | Dye | 5-MBT* | Relative Speed | Contrast | $D_{min}$ |
| L | — | SS-8 | — | 100 | 6.5 | .04 |
| LI | D-1 | SS-8 | — | 309 | >16.0 | .05 |
| LII | D-1 | SS-8 | 100 mg/mole | 204 | >16.0 | .04 |
| LIII | D-1 | SS-8 | 800 mg/mole | 126 | >16.0 | .03 |

*0.8 g 5-MBT also present per liter of developer.

coating LII was prepared similar to Coating LI except that 5-methylbenzotriazole was also added to the coating element at 100 mg/mole silver. Coating LIII was prepared similar to Coating LI with the exception that 5-methylbenzotriazole was added at 800 mg/mole silver. The coatings were exposed for 1/5" to a 500 watt 3000° K tungsten light source and processed for 68" in a developer similar to that of Example 1 (pH 12.0, 30° C.) containing 75 g/l of sodium sulfite and 0.8 g/l of 5-methylbenzotriazole.

As can be seen in Table VII, above, high contrast is obtained when 5-methylbenzotriazole is present in the coating element which also contains nucleating agent D-1 and spectral sensitizing Dye SS-8.

The invention has been described in detail with reference to preferred embodiments thereof but it will be understood that variations and modifications can be effected within the spirit and scope of the invention.

What is claimed is:

1. An image forming process which comprises imagewise exposing to light a photographic light-sensitive material comprising a support having thereon at least one silver halide photographic emulsion layer comprising substantially surface latent image type monodispersed silver bromide or silver iodobromide grains containing up to about 10 mol % silver iodide, wherein the average grain size of said silver halide grains is about 0.7 microns or less and a binder in an amount of about 250 g or less per mol of silver halide, wherein said silver halide photographic emulsion layer or at least one other hydrophilic colloid layer on said support contains a compound represented by the general formula (I):

$$R^1NHNHCOR^2$$

wherein $R^1$ represents an aryl group or a substituted aryl group and $R^2$ represents a hydrogen atom, and developing said photographic light-sensitve material with a developing solution containing, as developing agent, a member selected from the group consisting of (a) dihydroxy-benzene and (c) dihydroxybenzene plus 3-pyrazolidone or substituted 3-pyrazolidone wherein said dihydroxybenzene is present in an amount of about 0.05 mol/liter to about 0.5 mol/liter, said 3-pyrazolidone or substituted 3-pyrazolidone is present in an amount of not more than 0.06 mol/liter, and 0.15 mol/liter or more of sulfite ion and having a pH of about 11 to about 12,3, wherein the amount of the compound of the general formula (I) is $10^{-4}$ to $10^{-1}$ mol/mol Ag.

2. The image forming process as set forth in claim 1, wherein the development is carried out in the presence of at least one benzotriazole compound.

3. The image forming process as set forth in claim 2, wherein said benzotriazole compound is present in said developing solution.

4. The image forming process as set forth in claim 1, wherein said silver halide photographic emulsion contains a compound represented by the formula:

$$R^{11}NHNHCHO \qquad (Ib)$$

wherein $R^{11}$ represents an unsubstituted phenyl group, a p-tolyl group or an m-tolyl group.

5. The image forming process as set forth in claim 1, wherein said dihydroxybenzene is hydroquinone.

6. The image forming process as set forth in claim 1, wherein said developing solution further contains a 3-pyrazolidone developing agent.

7. The image forming process as set forth in claim 1, wherein the amount of compound represented by the formula (I) is $5\times10^{-4}$ to $5\times10^{-2}$ mol/mol Ag.

8. The image forming process as set forth in claim 1, wherein the amount of compound is $5\times10^{-3}$ to $5\times10^{-2}$ mol/mol/Ag.

9. The image forming process as set forth in claim 1, wherein said 3-pyrazolidone is present in an amount of not more than 0.03 mol/liter.

10. A process of imaging comprising developing an imagewise exposed photographic element in a developer, the photographic element comprising a support, coated on the support at least one negative-working photographic emulsion comprising radiation-sensitive silver halide grains of 0.7 micron or less mean grain size chosen from at least one of silver bromide and silver bromoidide of less than 10 mole percent silver iodide and a binder in a quantity of about 250 grams or less per mole of silver halide, and in said emulsion or in an adjacent hydrophilic colloid layer in an amount sufficient to increase contrast, a hydrazine compound of the formula $$R^1-NHNH\overset{O}{\overset{\|}{C}}H$$

wherein $R^1$ is a phenyl nucleus having a Hammet sigma valuederived electron withdrawing characteristic of less than +0.30, the developer containing about 0.15 mole or more of sulfite ion per liter and having a pH from about 11.0 to 12.3, and wherein developing is performed in the presence of at least one benzotriazole antifoggant.

11. An improved imaging process according to claim 10 wherein the benzotriazole antifoggant is present in the developer.

12. An improved process according to claim 10 in which the developer contains developing agents selected from among hydroquinone and pyrazolidone developing agents and mixtures thereof.

13. An improved imaging process according to claim 10 in which the photographic element is spectrally sensitized with a cyanine or merocyanine dye.

* * * * *